United States Patent [19]

Skeels

[11] Patent Number: 4,519,693

[45] Date of Patent: May 28, 1985

[54] DEVICE FOR TRANSFERRING PARTICULATE MATERIAL

[75] Inventor: Anthony J. Skeels, Hitchin, England

[73] Assignee: Xerox Corporation, Stamford, Conn.

[21] Appl. No.: 533,465

[22] Filed: Sep. 19, 1983

[30] Foreign Application Priority Data

Sep. 21, 1982 [GB] United Kingdom ..... 8226824

[51] Int. Cl.[3] ..... G03G 15/00

[52] U.S. Cl. ..... 355/3 DD

[58] Field of Search ..... 355/3 DD, 3 R; 222/DIG. 1, 165, 517, 105, 325

[56] References Cited

U.S. PATENT DOCUMENTS 2,893,604 7/1957 Critchlow ..... 222/535

3,954,331 5/1976 Smith ..... 222/DIG. 1

FOREIGN PATENT DOCUMENTS 57-60358 4/1982 Japan ..... 355/3 DD 2099732 12/1982 United Kingdom ..... 355/3 DD

*Primary Examiner*—A. T. Grimley

*Assistant Examiner*—David Warren

*Attorney, Agent, or Firm*—H. Fleischer; J. E. Beck; R. Zibelli

[57] ABSTRACT

An apparatus which transfers particles from a refill container into an open ended hopper. A cover closes the open end of the hopper with a chute being disposed interiorly of the hopper. When the cover is opened, the chute moves to an exterior position for receiving the refill container. The surface of the chute, in engagement with the refill container, is inclined to the horizontal so that the refill container does not have to be completely inverted when discharging particles into the hopper.

12 Claims, 7 Drawing Figures

DEVICE FOR TRANSFERRING PARTICULATE MATERIAL

This invention relates generally to an electrophotographic printing machine, and more particularly to an apparatus for refilling a toner dispenser used therein.

In many electrophotographic printing machines which consume particulate material, e.g. toner particles, there arises the problem of how to reload the machine with the material without spillage or wastage. Toner particles are strongly pigmented, finely-divided powder which need careful handling to avoid contamination of the printing machine and soiling of the operator's clothing and hands. A typical loading arrangement is to supply the toner powder in a refill container such as a carton or plastic bottle, and to load this into a hopper in the printing machine after removal of a hinged or removable lid. The toner powder is then simply tipped from the refill container into the hopper. Such an arrangement frequently gives rise to the escape of toner particles, firstly by an intial fall of the powder into the hopper which creates powder clouds, and secondly by the toner powder which falls from the refill containers as it is introduced into, and removed from, the vicinity of the hopper.

Various types of systems have been devised for adding toner particles to the toner dispenser of an electrophotographic printing machine. The following disclosures appear to be relevant:

U.S. Pat. No. 3,539,077
Patentee: Drexler et al.
Issued: Nov. 10, 1970
U.S. Pat. No. 3,999,654
Patentee: Pollack
Issued: Dec. 28, 1976
U.S. Pat. No. 4,062,385
Patentee: Katusha et al.
Issued: Dec. 27, 1977
U.S. Pat. No. 4,065,335
Patentee: Pollack
Issued: Dec. 27, 1977

The relevant portions of the foregoing art may be briefly summarized as follows:

Drexler et al. describes a toner container having an openable end constructed from a slitable material forming a seal over the container. As the container is inserted into the toner dispenser in the electrophotographic printing machine, a stationary knife slits the slittable material sealing the top of the container. The toner particles are then discharged from the container into the toner dispenser.

The Pollack patents describe a toner cartridge having a flexible tongue which is folded back over itself and covers the opening in the cartridge. The cartridge is inserted into the toner hopper in engagement with a resilient material disposed about the periphery of the hopper to form a seal therebetween. The tongue is then peeled from the cartridge to dispense toner particles therefrom into the hopper.

Katusha et al. describes a toner container having a removable tear strip which seals an opening in the container. A slidable cover automatically removes the tear strip from the container when the container is inserted into the toner hopper. The container engages a resilient material disposed around the periphery of the hopper to form a seal therebetween and the toner particles are discharged from the container into the hopper.

In accordance with one aspect of the features of the present invention, there is provided an apparatus for transferring particles from a refill container into an open ended hopper. Means are provided for closing the open end of the hopper. Means guide particles from the refill container into the hopper. The guiding means is positioned interiorly of the hopper when the closing means closes the open end of the hopper and moves, in response to the closing means being moved to open the open end of the hopper, to an exterior position for receiving the refill container. The surface of the guiding means in engagement with the refill container is inclined to the horizontal so that the refill container does not have to be completely inverted when discharging particles into the hopper.

Pursuant to another aspect of the present invention, there is provided an electrophotographic printing machine of the type having a toner dispenser for furnishing toner particles to the development system with a refill container supplying additional toner particles to the open ended hopper of the toner dispenser. Means are provided for closing the open end of the hopper. Means guide toner particles from the refill container into the hopper. The guiding means is positioned interiorly of the hopper when the closing means closes the open end of the hopper and moves, in response to the closing means being moved to open the end of the hopper, to an exterior position for receiving the refill container. The surface of the guiding means in engagement with the refill container is inclined to the horizontal so that the refill container does not have to be completely inverted with discharging toner particles into the hopper.

Other aspects of the present invention will become apparent as the following description proceeds and upon reference to the drawings, in which.

Figure 1:
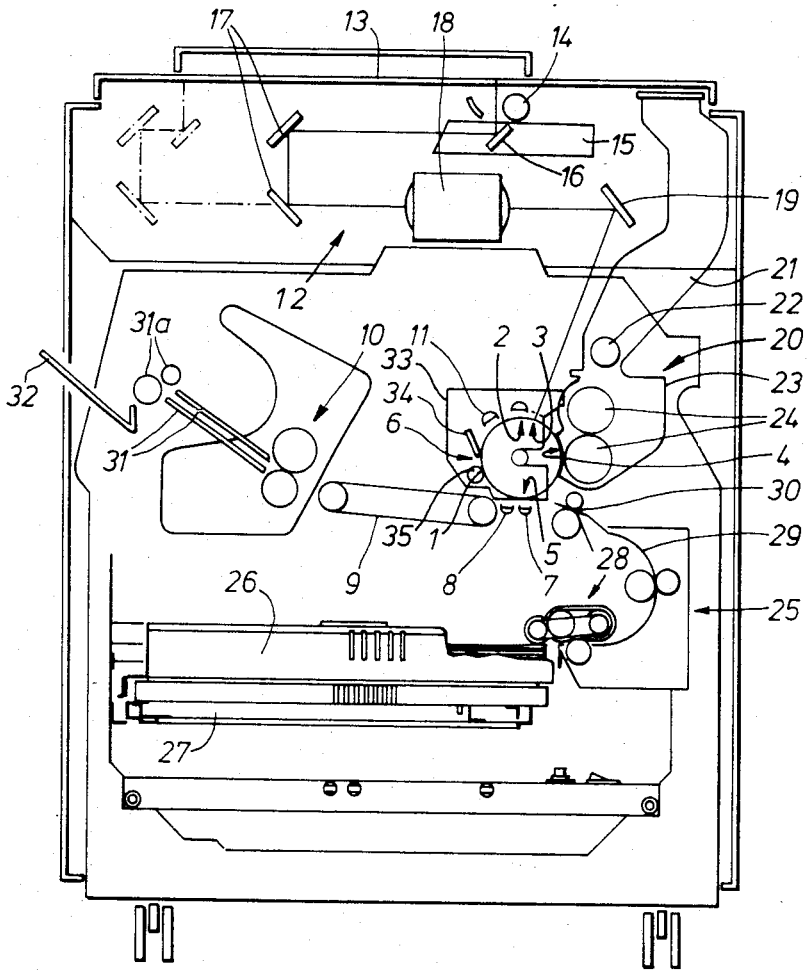
FIG. 1 is a schematic elevational view showing an electrophotographic printing machine incorporating the features of the present invention therein.

Referring first to FIG. 1 there is shown an electrophotographic printing machine incorporating the features of the present invention therein. The machine includes a photoreceptor drum 1 mounted for rotation (in the clockwise direction as seen in FIG. 1) to carry the photoconductive imaging surface of the drum sequentially through a series of xerographic processing stations: a charging station 2, an imaging station 3, a development station 4, a transfer station 5, and a cleaning station 6.

The charging station 2 comprises a corona generating device which deposits a uniform electrostatic charge on the photoreceptor. A document to be reproduced is positioned on a platen 13 and scanned by means of a moving optical scanning system to produce a flowing light image on the drum at 3. The optical image selectively discharges the photoconductor in image configuration, whereby an electrostatic latent image of the object is recorded on the drum surface. At the development station 4, the electrostatic latent image is developed into visible form by bringing into contact with it toner particles which deposit on the charged areas of the photoreceptor. Cut sheets of paper are moved into the transfer station 5 in synchronous relation with the image on the drum surface and the developed image is transferred to a copy sheet at the transfer station 5, where a transfer corona generating device 7 provides an electric field to assist in the transfer of the toner particles thereto. The copy sheet is then stripped from the drum 1, the detachment being assisted by the electric field provided by an a.c. detack corona generating device 8. The copy sheet carrying the developed image is then carried by a transport belt system 9 to a fusing station 10.

After transfer of the developed image from the drum, some toner particles usually remain on the drum, and these are removed at the cleaning station 6. After cleaning, any electrostatic charges remaining on the drum are removed by an a.c. erase corona generating device 11. The photoreceptor is then ready to be charged again by the charging corona generating device 2, as the first step in the next copy cycle.

The optical image at imaging station 3 is formed by optical system 12. A document (not shown) to be copied is placed on platen 13, and is illuminated by a lamp 14 that is mounted on a scanning carriage 15 which also carries a mirror 16. Mirror 16 is the full-rate scanning mirror of a full and half-rate scanning system. The full-rate mirror 16 reflects an image of a strip of the document to be copied onto the half-rate scanning mirror 17. The image is focused by a lens 18 onto the drum 1, being deflected by a fixed mirror 19. In operation, the full-rate mirror 16 and lamp 14 are moved across the machine at a constant speed, while at the same time the half-rate mirrors 17 are moved in the same direction at half that speed. At the end of a scan, the mirrors are in the position shown in a broken outline at the left hand side of FIG. 1. These movements of the mirrors maintain a constant optical path length, so as to maintain the image on the drum in sharp focus throughout the scan.

At the development station 4, a magnetic brush developer system 20 develops the electrostatic latent image. Toner is dispensed from a hopper 21 by means of a rotating foam roll dispenser 22, into developer housing 23. Housing 23 contains a two-component developer mixture comprising a magnetically attractable carrier and the toner, which is brought into developing engagement with drum 1 by a two-roller magnetic brush developing arrangement 24.

The developed image is transferred, at transfer station 5, from the drum to a sheet of copy paper (not shown) which is delivered into contact with the drum by means of a paper supply system 25. Paper copy sheets are stored in two paper trays, an upper, main tray 26 and a lower, auxiliary tray 27. The top sheet of paper in either one of the trays is brought, as required, into feeding engagement with a common, fixed position, sheet separator/feeder 28. Sheet feeder 28 feeds sheets around curved guide 29 for registration at a registration point 30. Once registered, the sheet is fed into contact with the drum in synchronous relation to the image so as to receive the image at transfer station 5.

The copy sheet carrying the transferred image is transported, by means of vacuum transport belt 9, to fuser 10, which is a heated roll fuser. The image is fixed to the copy sheet by the heat and pressure in the nip between the two rolls of the fuser. The final copy is fed by the fuser rolls along output guides 31 into catch tray 32, which is suitably an offsetting catch tray, via output nip rolls 31*a*.

After transfer of the developed image from the drum to the copy sheet, the drum surface is cleaned at cleaning station 6. At the cleaning station, a housing 33 forms with the drum 1 an enclosed cavity, within which is mounted a doctor blade 34. Doctor blade 34 scrapes residual toner particles off the drum, and the scraped-off particles then fall into the bottom of the housing, from where they are removed by an auger 35.

Figure 2:
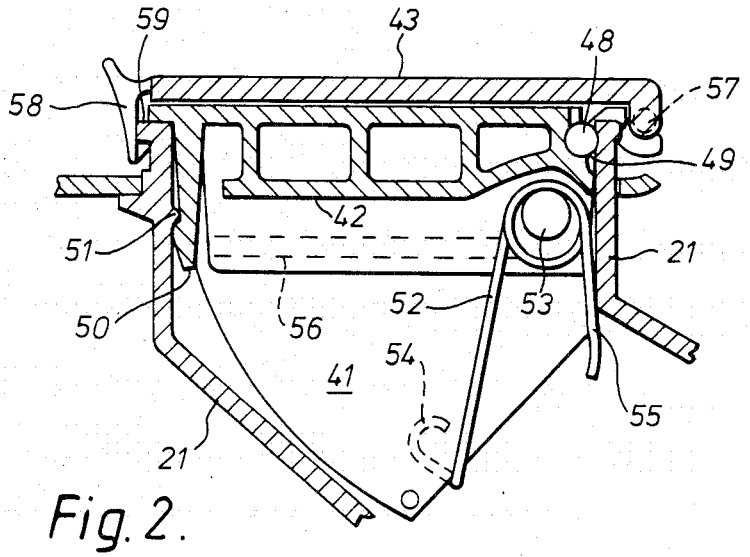
FIG. 2 is an elevational view, partially in section, showing the device of the invention, taken at one end, with the device in its "closed" position.
Figure 3:
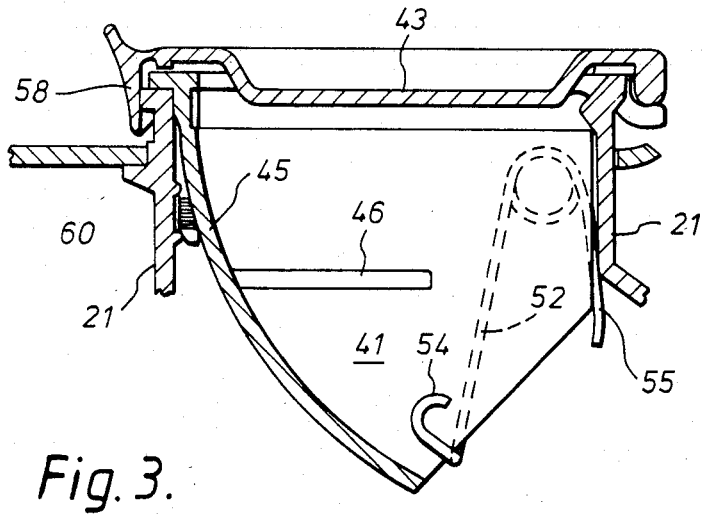
FIG. 3 is an elevational view, partially in section, showing the device of the invention, taken in the center, with the device in its "closed" position.
Figure 4:
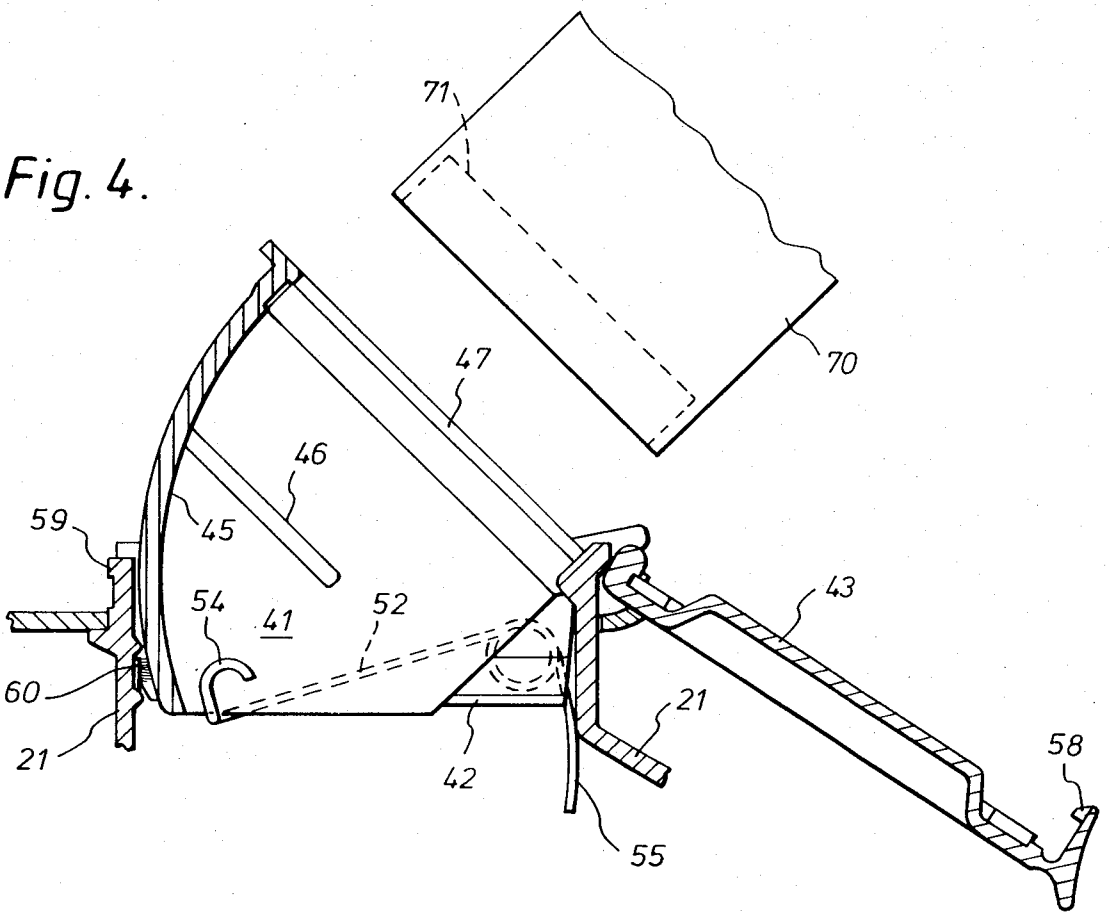
FIG. 4 is an elevational view, partially in section, showing the FIG. 3 device in its "open" position.
Figure 5:
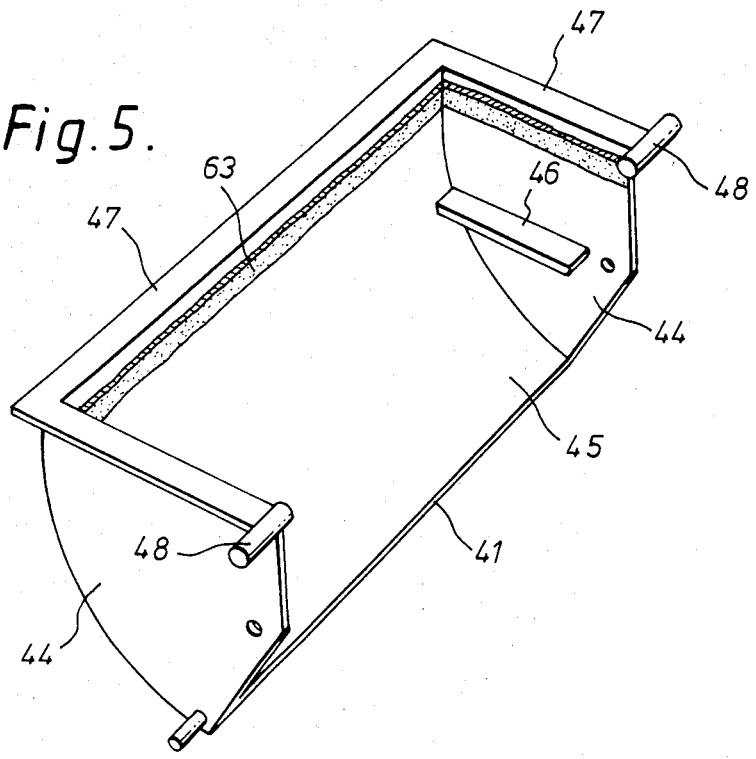
FIG. 5 is a perspective view depicting the chute of the device.

Referring now to FIGS. 2 through 7, the apparatus of the invention is a clip-in fit to the horizontal aperture which forms the mouth of the toner hopper 21. The apparatus consists of five main parts, which may suitably be plastics mouldings, four of which are as shown in FIGS. 3 to 5, and the fifth of which is either one of the two inserts shown in FIGS. 6 and 7.

As shown in FIGS. 2 through 5, the device includes a chute 41, two end pieces 42 and a lid 43. The chute 41, as most clearly seen in FIG. 5, has end walls 44 and a partially cylindrical curved surface 45. Each end wall 44 carries, inside the chute, a rib 46 which extends parallel with the upper rim 47 of the chute, for receiving either one of the inserts shown in FIGS. 6 and 7. The chute is arranged for pivotal movement by means of pivot pins 48 extending outwardly from the corners of the end walls 44 remote from the curved surface 45, the pivot pins being substantially on the cylindrical axis of the surface 45. The pivot pins 48 are pivotally engaged in bearings 49 formed in the end pieces 42.

The end pieces 42, supporting the chute 41, are secured into the top of the hopper 21 by means of resilient catch portions 50 of the end pieces 42 which engage a ridge 51 in the left hand wall of the hopper 21 (as viewed in FIG. 2), as well as by spring members 52. Each of the spring members 52 has at least one coil which is supported by passing around a peg 53 formed on the end piece 42. The spring 52 is shaped so as to have a hook portion 54 at one end which engages the end wall 44 of the chute 41, and a substantially straight portion 55 at the other end which pushes against the right hand wall of the toner hopper 21.

The end walls 44 of chute 41 are slidable between end pieces 42, and the springs 52 urge the chute in the clockwise direction, as shown in FIGS. 2 through 4. Sealing strips 56, such as brush seals, are carried on the inside surfaces of the end pieces 42, as indicated by the broken lines of FIG. 2.

The chute 41 is normally held in the position shown in FIGS. 2 and 3, against the force of spring 52, by means of the lid 43 which also acts as a sealing closure for the hopper 21. Lid 43 is pivoted by means of pivot pins 57 formed on its right hand edge, as depicted in FIG. 2, in bearings formed in the end pieces 42. Latching members 58 on the left hand edge of the lid engage a ridge 59 formed at the top of the hopper 21.

When the lid 43 is undone, it may be pivoted through more than 180°, to take up a position shown in FIG. 4, at the same time allowing the chute 41 to pop out until its upper rim 47 is inclined at about 45° to the horizontal. A sealing strip 60, such as a brush seal, is mounted on the inside left hand wall of hopper 21 to provide a seal between that wall of the hopper and the curved surface 45 of the chute 41, regardless of the position of chute 41.

Figure 6:
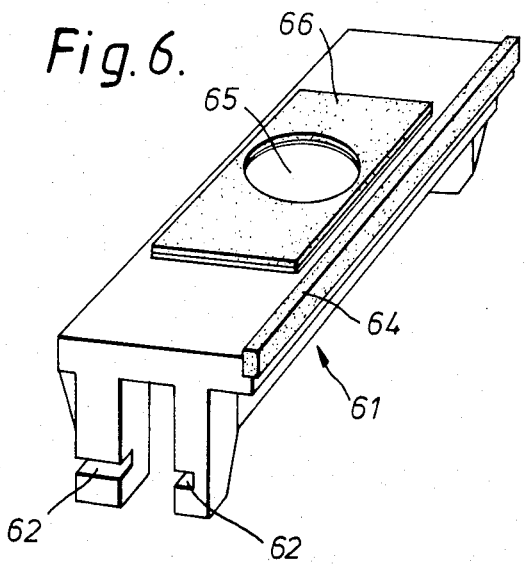
FIG. 6 is a perspective view of the bottle receiver which is placed in FIG. 5 chute.

Referring now to FIGS. 5 and 6, the insert 61 shown in FIG. 6 may be inserted into chute 41 by sliding channels 62 of insert 61 over the ribs 46. A sealing strip 63 around the three sides of the rim 47 of chute 41, and a sealing strip 64 along the remaining edge of insert 61, provide a complete seal between the insert 61 and the chute 41, and therefore effectively form a complete seal between the insert 61 and the hopper 21. The top face of insert 61 has a circular aperture 65 which is surrounded by a foam rubber seal 66. The aperture 65 and seal 66 are shaped to receive the neck of a toner refill container in the form of a disposable plastics bottle, the neck of which fits through the aperture 65, and the shoulders of which form a closure with seal 66. In order to reload the hopper from a refill bottle, therefore, the sequence is as follows. The lid 43 is opened, and chute 41 pops up to the position shown in FIG. 4. The cap or seal of the refill bottle is removed and the neck of the bottle brought up to the aperture 65 with the bottle in a substantially horizontal position. The body of the bottle is then moved upwards and the neck inserted into the aperture 65, until the shoulders of the bottle form a closure with the seal 66. The bottle is then raised to a substantially vertical position, by hinging the chute back into the hopper 21 against the force of springs 52, so as to dump the toner into the hopper. Once empty, the bottle is removed after allowing the chute 41 to pop out again to the 45° position. The lid 43 is then closed to seal the hopper.

Figure 7:
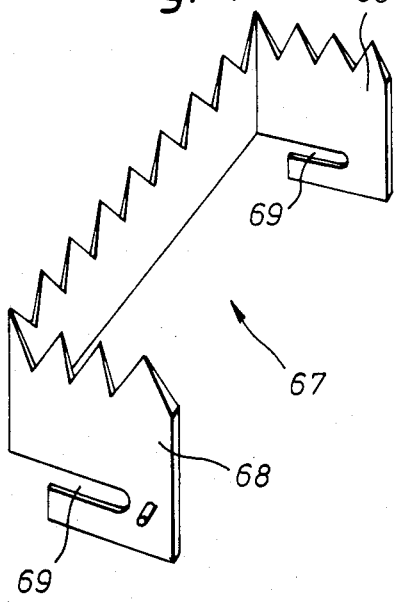
FIG. 7 is a perspective view of a perforator which is placed in FIG. 5 chute as an alternative to the FIG. 6 bottle receiver.

In an alternative embodiment of the invention, the insert 67 shown in FIG. 7 is used. The insert 67 consists of three walls which fit around the inside of chute 41, the two end walls 68 of insert 67 having slots 69 formed in them for engagement over the ribs 46 of chute 41. The upper edges of the walls of insert 67 are sharply serrated as shown to form cutting edges. The cutting edges, when the insert 67 is in place, are spaced from the inside walls of chute 41 by a distance which is sufficient to permit the insertion of the top of a refill carton of the kind indicated diagrammatically in FIG. 4. The carton 70 is of cuboidal form having four sides and a bottom formed of, for example, cardboard. A suitable sealed container for the toner material, for example of flexible plastics material, is secured inside the carton, and is sealed by means of a taut membrane set inside the open top of the carton, as indicated in broken outline at 71 in FIG. 4.

In order to load the toner from such a refill carton, the lid 43 of the device is opened as before, allowing the chute 41 to pop up to the position in FIG. 4. The carton top is introduced directly into the open top of chute 41, with the cutting edges of insert 67 close to, but not touching, the membrane 71. The carton is then inverted (i.e. the chute 41 pushed down against the spring 52) and pushed firmly downwards so that the cutting edges of insert 67 cut the membrane along three sides close to the inside wall of the carton, allowing the membrane to hinge downwards about its remaining edge and dump the toner into the hopper. In order to remove the empty carton, the chute 41 is allowed to pop up again to the 45° position and the carton is withdrawn. The lid 43 is then closed.

As will be appreciated from the foregoing, the toner loading operation is carried out in such a way that as the toner is dumped from the refill container, there is a substantially sealed closure between the refill container and the hopper, leading to a virtually clean loading operation.

While this invention has been described in conjunction with specific embodiments thereof, it is evident that many alternatives, modifications and varitions will be apparent to those skilled in the art. Accordingly, it is intended to embrace all such alternatives, modifications and variations as fall within the spirit and broad scope of the appended claims.

What is claimed is:

1. An apparatus for transferring particles from a refill container into an open ended hopper, including:

means for closing the open end of the hopper; and means for guiding particles from said refill container into said hopper, said guiding means being positioned interiorly of the hopper when said closing means closes the open end of the hopper and moving, in response to said closing means being moved to open the open end of the hopper, to an exterior position for receiving the refill container with the surface of said guiding means having a surface in engagement with the refill container and the surface being inclined to the horizontal so that the refill container does not have to be completely inverted when discharging particles into the hopper.

2. An apparatus according to claim 1, wherein said guiding means includes a chute mounted pivotably on said hopper.

3. An apparatus according to claim 2, wherein said closing means includes a cover mounted pivotably on the hopper.

4. An apparatus according to claim 3, further including means for resiliently pivoting said chute from the interior of the hopper to the exterior position for receiving the refill container in response to said cover being pivoted from the position closing the hopper to the position opening the hopper.

5. An apparatus according to claim 4, further including means, mounted on the surface of said chute in engagement with said refill container, for perforating a portion of the refill container to permit the particles to be discharged therefrom into said chute so as to be guided into the hopper.

6. An apparatus according to claim 4, further including a member mounted on the surface of said chute in engagement with the refill container, said member having an aperture for receiving the open end of the refill container in sealing engagement.

7. An electrophotographic printing machine of the type having a toner dispenser for furnishing toner particles to the development system with a refill container supplying additional toner particles to the open ended hopper of the toner dispenser, wherein the improvement includes:

means for closing the open end of the hopper; and means for guiding toner particles from said refill container into said closing means closes the open end of the hopper and moving, in response to said closing means being moved to open the open end of the hopper, to an exterior position for receiving the refill container with the surface of said guiding means having a surface in engagement with the refill container and the surface being inclined to the horizontal so that the refill container does not have to be completely inverted when discharging toner particles into the hopper.

8. A printing machine according to claim 7, wherein said guiding means includes a chute mounted pivotably on said hopper.

9. A printing machine according to claim 8, wherein said closing means includes a cover mounted pivotably on the hopper.

10. A printing machine according to claim 9, further including means for resiliently pivoting said chute from the interior of the hopper to the exterior position for receiving the refill container in response to said cover being pivoted from the position closing the hopper to the position opening the hopper.

11. A printing machine according to claim 10, further including means, mounted on the surface of said chute in engagement with said refill container, for perforating a portion of the refill container to permit the toner particles to be discharged therefrom into said chute so as to be guided into the hopper of the toner dispsenser.

12. A printing machine according to claim 10, further including a member mounted on the surface of said chute in engagement with the refill container, said member having an aperture for receiving the open end of the refill container in sealing engagement.

* * * * *